US008430640B2

(12) United States Patent
Mauchle et al.

(10) Patent No.: US 8,430,640 B2
(45) Date of Patent: Apr. 30, 2013

(54) POWDER SPRAY COATING DEVICE AND POWDER TRANSPORT DEVICE THEREFOR

(76) Inventors: Felix Mauchle, Abtwil (CH); Christian Marxer, Fuerstentum (LI)

( * ) Notice: Subject to any disclaimer, the term of this patent is extended or adjusted under 35 U.S.C. 154(b) by 413 days.

(21) Appl. No.: 12/680,204

(22) PCT Filed: Sep. 15, 2008

(86) PCT No.: PCT/IB2008/002402

§ 371 (c)(1),
(2), (4) Date: Mar. 26, 2010

(87) PCT Pub. No.: WO2009/044242

PCT Pub. Date: Apr. 9, 2009

(65) Prior Publication Data

US 2010/0243759 A1 Sep. 30, 2010

(30) Foreign Application Priority Data

Sep. 29, 2007 (DE) ..... 10 2007 046 806

(51) Int. Cl.
*F04B 49/00* (2006.01)

(52) U.S. Cl.
USPC ..... 417/12; 417/46; 417/187; 700/282; 700/283

(58) Field of Classification Search ..... 417/46, 417/185, 187, 188, 190, 12; 239/329–334, 239/349, 351, 355, 356, 363; 700/282, 283; 222/61, 63, 329, 334, 349
See application file for complete search history.

(56) References Cited

U.S. PATENT DOCUMENTS

| | | | | |
|---|---|---|---|---|
| 2,600,493 | A * | 6/1952 | Farris | 251/31 |
| 3,292,852 | A * | 12/1966 | Shinskey | 235/200 WB |
| 4,268,005 | A * | 5/1981 | Raftis et al. | 251/5 |
| 4,284,032 | A | 8/1981 | Moos et al. | |
| 4,357,900 | A | 11/1982 | Buschor | |
| 5,420,578 | A * | 5/1995 | O'Brien et al. | 340/870.13 |

(Continued)

FOREIGN PATENT DOCUMENTS

| | | |
|---|---|---|
| DE | 19611533 A1 | 9/1997 |
| EP | 0636420 A2 | 2/1995 |

(Continued)

OTHER PUBLICATIONS

ISR for PCT/IB2008/002402 dated Feb. 18, 2009.

*Primary Examiner* — Charles Freay
*Assistant Examiner* — Joseph Herrmann
(74) *Attorney, Agent, or Firm* — Lowe Hauptman Ham & Berner, LLP

(57) ABSTRACT

A powder feed apparatus for a powder spraycoating equipment includes a dense phase powder pump fitted with at least two feed chambers, alternatingly discharging coating powder. Each feed chamber includes a powder intake valve to aspirate coating powder during a suction stage and one powder outlet valve to discharge coating powder during a discharge stage. Each feed chamber further includes control valves to operate the dense phase powder pump and a control unit controlling the dense phase powder pump by the control valves. A dependence mode of the total open time ($t_{total}$) of the powder intake valves defines the dependence of the total open time ($t_{total}$) on an adjustable nominal value ($m_p$) adjusted by a powder adjusting element and relating to the rate of powder to be conveyed by the dense phase powder pump, and defining a response delay time ($t_{delay}$) and an apparatus constant (C).

10 Claims, 3 Drawing Sheets

U.S. PATENT DOCUMENTS

Figure 1:
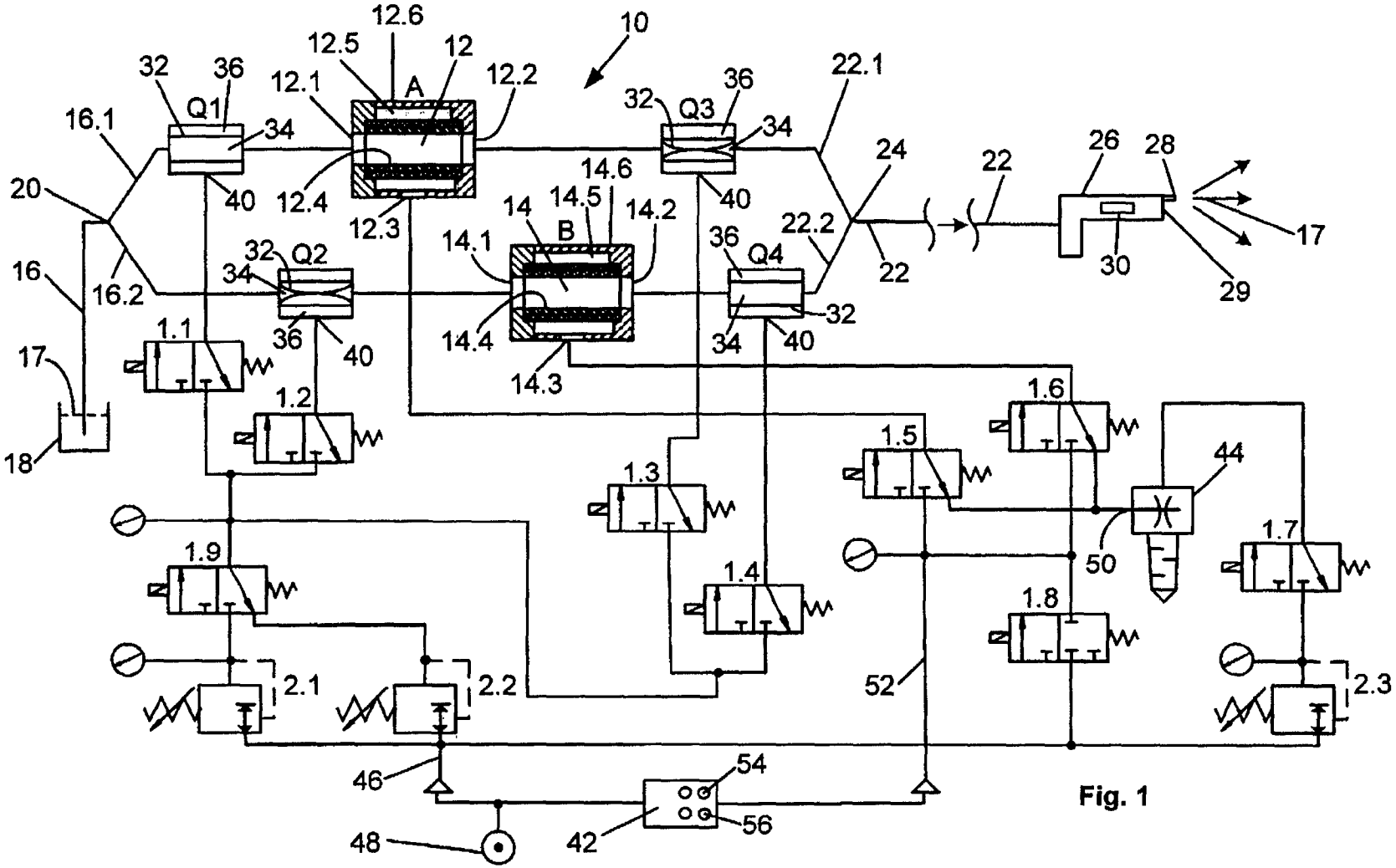

| | | | | |
|---|---|---|---|---|
| 5,473,947 | A * | 12/1995 | Buquet | 73/861.04 |
| 5,702,209 | A * | 12/1997 | Mauchle | 406/12 |
| 6,382,521 | B1 * | 5/2002 | Haas | 239/69 |
| 7,150,585 | B2 * | 12/2006 | Kleineidam et al. | 406/50 |
| 7,204,158 | B2 * | 4/2007 | Morgan et al. | 73/861.42 |
| 7,287,964 | B2 * | 10/2007 | Sanwald | 417/397 |
| 7,452,166 | B2 * | 11/2008 | von Keudell et al. | 406/98 |
| 7,465,130 | B2 * | 12/2008 | Herre et al. | 406/50 |
| 7,731,456 | B2 * | 6/2010 | Fulkerson et al. | 406/97 |
| 2005/0178325 | A1 | 8/2005 | Herre et al. | |
| 2006/0193704 | A1 | 8/2006 | Simontacchi | |
| 2007/0092380 | A1 * | 4/2007 | Fulkerson et al. | 417/65 |

FOREIGN PATENT DOCUMENTS

| | | | |
|---|---|---|---|
| EP | 1566353 | A2 | 8/2005 |
| EP | 1772195 | A2 | 4/2007 |
| JP | 9071325 | A | 3/1997 |

* cited by examiner

POWDER SPRAY COATING DEVICE AND POWDER TRANSPORT DEVICE THEREFOR

RELATED APPLICATIONS

The present application is national phase of PCT/IB2008/002402, filed Sep. 15, 2008, and claims priority from, German Application Number 10 2007 046 806.9, filed Sep. 29, 2007, the disclosures of which are hereby incorporated by reference herein in their entirety.

The present invention relates to a powder spray coating device—hereafter powder spraycoating equipment—and to a powder transport device—hereafter powder feed apparatus—for said equipment.

Dense phase powder pumps comprise at least one feed chamber fitted with a powder intake valve and a powder outlet valve. The feed chamber is alternatingly connected to a vacuum source during a suction stage and to a source of conveying compressed air during a discharge stage. The vacuum from said vacuum source aspirates powder through the open powder intake valve into the feed chamber while the powder outlet valve is closed. The conveying compressed air from the source of conveying compressed air discharges powder from within the feed chamber through the open outlet valve while the intake valve is closed. Most dense phase powder pumps comprise two feed chambers operating at different time phases in order that alternatingly coating powder shall be aspirated each time into one feed chamber while the pertinent other feed chamber discharges coating powder.

Different kinds of coating powder feed apparatus containing a dense phase powder pump are known for instance from the following documents: JP 09/071,325 A, DE 196 11 533 B4, US 2000/0193704 A1 (=EP 1 644 131 A2), U.S. Pat. No. 7,150,585 B2 (=WO 2004/087331 A1) and US 2005/0178325 A1 (=EP 1 566 352 A2). A vacuum intake of at least one of the two feed chambers and in some embodiment modes also the compressed air intake of the feed chamber is/are fitted with a filter permeable to air but not to coating powder. The preferred filter material is a sintered one. Predominantly the powder intake and outlet valves are pinch valves.

The quantity of powder per unit time—hereafter powder rate—fed by a dense phase powder pump in particular depends on the size (volume) of the feed chamber, on the frequency at which coating powder is aspirated into the feed chamber and then discharged from it, on the magnitude of the vacuum, on the time the powder intake valve is open during suction and on the flow impedances in the powder conduits upstream of the dense phase powder pump and especially downstream of it. The flow impedances depend in particular on the length and the inside cross-section of the powder conduits, mostly powder hoses. The compressed conveying air mixes only little with the coating powder which it pushes through the powder outlet valve out of the feed chamber.

Different conditions apply to light phase powder pumps using injectors as the powder pump to feed the coating powder. Using a flow of conveying compressed air, a partial vacuum is generated in the injector. This partial vacuum aspirates coating powder into the conveying flow of compressed air. The mixture of powder and conveying compressed air flow moves from the injector to a target site, for instance a bin or a spray tool. The powder rate fed by the injector depends on the rate of conveying compressed air passing through the injector. Powder spraycoating equipment fitted with an injector illustratively is known from U.S. Pat. Nos. 4,284,032. 4,357,900 discloses powder spraycoating equipment wherein objects to be coated are moved through a cabin wherein they are automatically coated by spray tools driven by sensors, one of such sensors notifying a control unit when an object to be coated is being moved into said cabin in order that the spray tool be activated when said object moves into the coating range of said tool. Another sensor determines the kind of object involved, the electrical signals transmitted by this second sensor determining automatically the powder rate to be deposited on said object. EP 0 412 289 B1 discloses an electrostatic powder spraycoating apparatus fitted with an injector and with means keeping constant the total quantity of air fed to the spray tool and consisting of the conveying compressed air plus supplemental air that is added to the stream of powder. EP 0 636 420 A2 discloses powder spraycoating apparatus fitted with a control allowing adjusting the rate of fed powder and—depending on that adjustment and using stored functions—adjusting the rate of conveying compressed air and a rate of supplemental compressed air. Said functions are stored in graphic form.

Powder feed apparatus containing a dense phase powder pump incur the drawback that theoretically identical designs frequently entail nevertheless different rates of conveyed\powder even when the same reference/setpoint values have been set. This feature is due to different tolerances and different material properties of theoretically identical parts materials. Illustratively pinch valves may display different response times when they differ in resilient deformations of their valve hoses. Another instance are different airflow impedances in a filter in the suction flow of the vacuum source.

The objective of the present invention is to attain in simple manner approximately identical actual rates of powder stream for identical setpoint adjustments.

The present invention advantageously makes it possible to design powder spraycoating equipment and powder spray apparatus that are identical in theory but in practice differ on account of tolerance differentials and materials' deviations in a manner that a given setpoint of quantity of powder, for instance 60% or another percentage of a maximally possible powder discharge rate of 100% will assure in all equipment and apparatus the same actual value of powder rates (powder discharge rate).

The present invention is elucidated below in relation to the appended drawings and illustrative embodiment modes.

Figure 2:
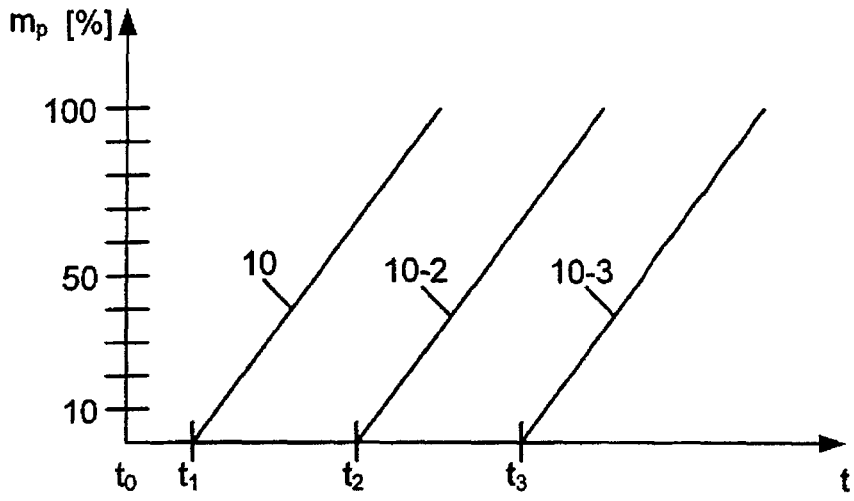
Figure 3:
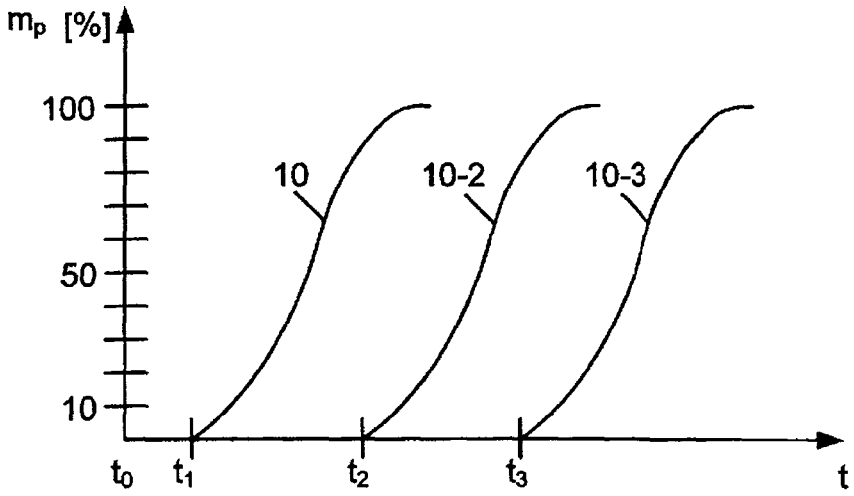
Figure 4:
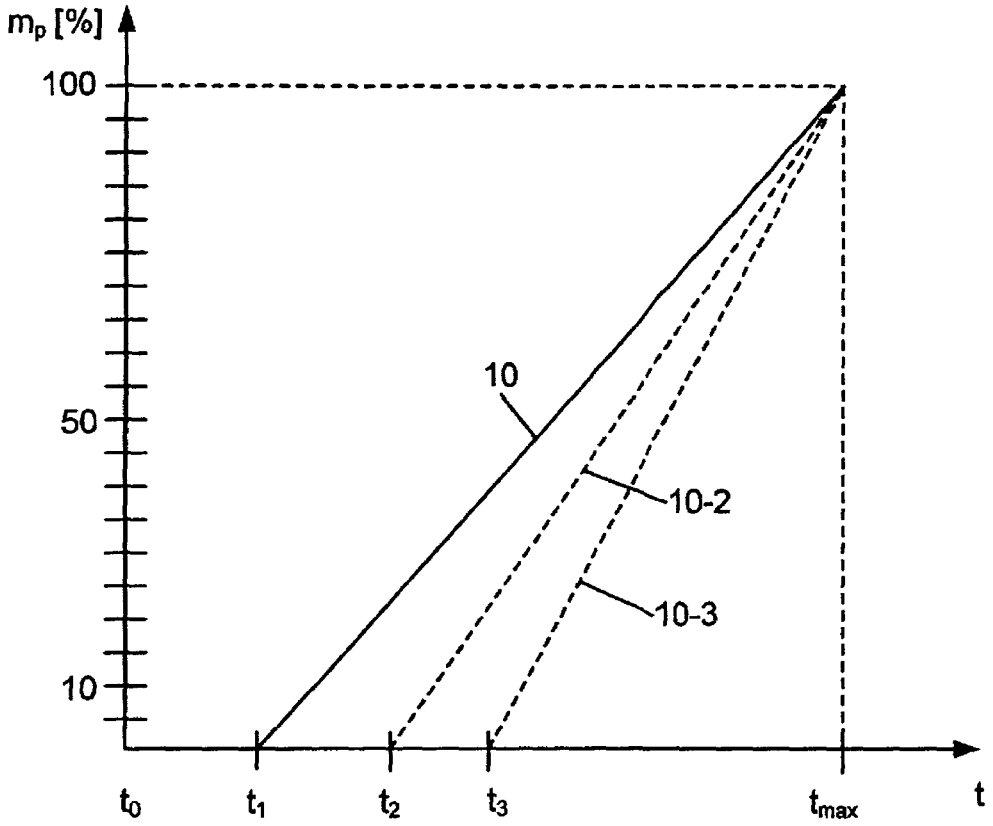

FIG. 1 schematically shows powder spraycoating equipment of the invention comprising powder feed apparatus also of the present invention, FIG. 2 shows a graph of the invention, FIG. 3 shows another graph of the invention, and FIG. 4 shows still another graph of the invention.

FIG. 1 schematically shows a powder feed apparatus of the invention which together with a spray tool 26 constitutes a powder spraycoating equipment.

The spray tool 26 may be a manually operated spray gun or a controlled, automated spray means. Preferably it contains at least one high-voltage (hv) electrode 28 which is fed with hv from a hv source 30 to electrostatically charge the coating powder 17 sprayed by the spray tool 26. The hv source 30 may be integrated into the spray tool 26. Said spray tool may be fitted with a spray aperture 25 or with a rotary atomizer.

The dense phase powder pump 10 contains at least one, preferably two feed chambers 12 respectively 14 each in a pump part A respectively B. A powder intake valve Q1 respectively Q2 is integrated at a powder intake 12.1 or 14.1 of the feed chamber 12 or 14. Powder outlet valves Q3 and Q4 respectively are configured at a powder outlet 12.2 and 14.2 of the feed chambers 12 and 14. The powder intake valves Q1 and Q2 and the powder outlet valves Q3 and Q4 are configured preferably directly at or in the powder intake 12.1 and 14.1 respectively the powder outlet 12.2 and 14.2. They are shown spaced from the powder intake respectively the powder outlet solely for clarity.

Powder feed conduits 16.1 and 16.2 are connected to the intake side of the powder intake valves Q1 and Q2 and may run separately to one or two powder bins 18, or, as shown in FIG. 1, they may be connected by means of a branch element 20 to the common powder feed conduit 16 running into the powder bin 18.

The powder outlet side of the powder outlet valves Q3 and Q4 is connected by the powder discharge conduits 22.1 respectively 22.2 and a branch element 24 to a common powder discharge conduit 22 connected to the spray tool 26.

Each feed chamber 12 or 14 is alternatingly connected during a suction stage to a vacuum source 44 or during a discharge stage to a source 48 of compressed conveying air. By means of said vacuum, coating powder 17 is aspirated through the open powder intake valve Q1 respectively Q2 into the feed chamber 12 or 15 while the powder outlet valve Q3 or Q4 is closed. Using the compressed conveying air from the source 48, the powder inside feed chamber 12 respectively 14 is discharged through the open powder outlet valve Q3 or Q4 while the powder intake valve Q1 or Q2 is closed. The two feed chambers 12 and 14 operate in mutually time-staggered manner so that alternatingly coating powder is aspirated in one of the two feed chambers 12 and 14 while coating powder is discharged from the other feed chamber 14 and 12.

The powder intake valves Q1 and Q2 and the powder outlet valves Q3 and Q4 may be controlled, arbitrary valves driven by the control unit 42. Preferably however they shall be pinch valves fitted with a flexible hose 32 which subtends a valve duct 34 for the coating powder and which can be squeezed together by compressed air in the actuating pressurized chamber 36 enclosing the hose 32 for the purpose of closing the valve duct 34. The hose 32 offers such resilience or intrinsic stress that after the pressure exerted by the compressed air is eliminated from the said actuation pressurized chamber 36, said hose shall automatically straighten out and thereby open the valve duct 34.

FIG. 1 shows the feed chamber 12 during the suction stage when its powder intake valve Q1 is open and its powder outlet valve Q3 is closed. The other feed chamber 14 is in its powder discharge stage wherein its powder intake valve Q2 is closed and its powder discharge valve Q4 is open.

The powder intake valves Q1 and Q2 may be alternatingly fed by means of control valves 1.1 and 1.2 with compressed air from the compressed air source 48 or be vented into the external atmosphere (or be connected to the vacuum source). The powder outlet valves Q3 and Q4 alternatingly can be loaded with compressed air by means of control valves 1.3 and 1.4 from the compressed air source 48 or be vented (or connected to the vacuum source). Preferably a pressure regulator 2.2 shall be configured between the control valves 1.1, 1.2, 1.3 and 1.4 and the compressed air source 48. In the preferred embodiment mode of FIG. 1, a second pressure regulator 2.1 is configured in parallel with the pressure regulator 2.2 and one of the two pressure regulators can be connected by means of a further control valve 1.9 to the control valves 1.1, 1.2, 1.3 and 1.4. In this manner compressed air at the pressure of one of the pressure regulators 2.2 or at the pressure of the other pressure regulator 2.1 may alternatingly be applied to the powder valves Q1, Q2, Q3 and Q4.

An air exchange aperture 12.3 respectively 14.3 is fitted into a housing 12.6 and 14.6 to alternatingly apply a vacuum or compressed air to the feed chamber 12 or 14, said aperture communicating by means of an annular chamber 12.5 or 14.5 and a filter 12.4 or 14.4 with the feed chamber 12 or 14. The filter 12.4 respectively 14.4 is permeable to gases, in particular compressed air, but not to coating powder particles. The filter 12.4 respectively 14.4 advantageously constitutes the peripheral/circumferential wall of the feed chambers 12 and 14.

The air exchange apertures 12.3 and 14.3 can be alternatingly connected by control valves 1.5 and 1.6 and the control unit 42 with the compressed air source 48 or the vacuum source 44.

The present invention moreover may include a control valve 1.8 in order to directly connect the air exchange apertures/hookups 12.3 and 14.3 to the compressed air source 48 instead of through a pressure regulator in the control unit 42.

A compressed air conduit 52 connects the control unit 42 to the control valves 1.5 and 1.6. Compressed air conduits 46 connect the compressed air source 48 to the pressure regulators 2.1 and 2.2.

Illustratively the vacuum source 44 may be fitted with an injector wherein a flow of compressed air creates a (partial) vacuum at a vacuum hookup 50. The flow of compressed air illustratively may be fed by a pressure regulator 2.3 and a control valve 1.7 to the vacuum injector 44. The pressure regulator 2.3 is connected through the compressed air conduit 46 to the compressed air source 48. All control valves 1.1, 1.2, 1.3, 1.4, 1.5, 1.6, 1.7, 1.8 and 1.9 are driven by the control unit 42.

The electrical control unit 42 contains at least one computer driving the dense phase powder pump 10 by means of the control valves 1.1, 1.2, 1.3, 1.4, 1.5 and 1.6, and, to the extent being used, also the control valves 1.7, 1.8 and 1.9.

The control unit 42 stores the time function $t_{total}$ of the total opening duration of the powder intake valves Q1 and Q2 defining the dependence of said function on the (nominal) reference value $m_p$ adjustable at the control unit 42 by means of a powder adjusting element 54 for the powder stream rate conveyed by the dense phase powder pump 10, further on a response delay $t_{delay}$ and an apparatus constant C. The powder rate is that percentage powder rate delivered by the dense phase powder pump. The response delay time $t_{delay}$ is that duration elapsing between the transmission of a command to open from the control unit 42 to one of the control valves 1.1 and 1.2 to open the pertinent power intake valve Q1 or Q2 of the feed chamber 12 or 14 in the suction phase to the onset of powder flow into said feed chamber 12 or 14 during the suction stage through the at least partly open powder intake valve Q1 respectively Q2. The adjustment range of the powder adjusting element 54 is from 0 to 100%, this range being divided into corresponding values from 0 to 100% of the particular delivered powder rate from the dense phase powder pump 120. The value of 0% denotes the state of the onset of powder flow through the powder intake valve Q1 respectively Q2 of the feed chamber 12 or 14 in its suction stage. The value of 100% denotes the maximum powder rate output by the dense phase powder pump 10 at a defined maximum duration of opening of the powder intake valves Q1 respectively Q2 of the feed chambers 12 and 14.

The present invention is applicable also to dense phase powder pumps which, instead of two, only comprise one feed chamber 12 or 14.

In the preferred embodiment mode of the invention, the adjustment range division of the powder adjusting element 54 is linear from 0 to 100 and each setpoint percentage linearly corresponds to the percentage of the actually moved f powder discharge rate of the dense phase powder pump 10.

The dependency relation may be implemented in different kinds and be stored in hardware or software in the control unit 42.

In a preferred implementation of the present invention, the dependency relation is stored in the form of a mathematical function by means of which the control unit 42 calculates—for each percentage adjustable at the powder adjusting element 54 —the pertinent equal percentage of powder discharge rate and controls accordingly the dense phase pump powder 10 whereby it feeds the calculated powder discharge rate.

Preferably the mathematical formula shall be stated as follows:

$$t_{total}=t_{delay}+m_pC$$

In this formula, $t_{total}$ denotes the total duration (measured in ms) of the suction stage from the onset of the command to open the powder intake valve Q1 or Q2 to the onset of a command to close transmitted by the control unit 42 to the powder intake valve Q1 respectively Q2. The term $t_{delay}$ denotes the response delay time (measured in ms) from the onset of the command to open to the onset of coating powder flow through the at least partly opened powder intake valve Q1 respectively Q2 to be opened. The term $m_p$ denotes the rate of powder stream (setpoint) in percent relative the maximally possible powder rate at a predetermined maximum duration of open powder intake valve Q1' respectively Q2. The term C is an empirically determined value relating to the powder feed apparatus and depends on its design and also may be affected by the powder flow impedance downstream of the dense phase powder pump.

In another mode implementing the present invention, the dependence mode may be stored in the form of a rectilinear or curved function plot by means of which—for each adjustable percentage set at the powder setting element 54 —the control unit 42 calculates the same corresponding percentage of the powder discharge rate and the dense phase powder pump 10 by means of the control valves 1.1 through 1.7 commensurately controls the calculation, as a result of which the dense phase powder pump 10 conveys the percentage of powder discharge rate as was set at the powder adjusting element 54.

As regards the dense phase powder pumps 10, 10-2 and 10-3 of three theoretically identical powder feed apparatus, FIGS. 2, 3 and 4 show the rate of conveyed powder $m_p$ depending on the duration of opening t of the powder intake valves Q1 and Q2. The plots assume that the dense phase powder pump 10 has a response time delay $t_{delay}$ from the time $t_0$ to the time $t_1$; that the second dense phase powder pump 10-2 has a response time delay $t_{delay}$ from the time $t_0$ to the time $t_2$; and that the third dense phase powder pump 10-3 has a response time delay from the time $t_o$ to the time $t_3$, in each case from the transmission of the command to open by the control unit 42 to the control valve 1.1 respectively 1.2 of the powder intake valve Q1 or Q2 until the onset of the coating powder stream through the at least partly open powder intake valve Q1 respectively Q2 to be opened.

In a preferred embodiment mode of the present invention, the response time delay $t_{delay}$ at the control unit 42 can be changed variably by means of a delay-time adjusting element 56 in said control unit 42 in a manner that the rectilinear lines of FIG. 2 or the curves of FIG. 3 of the three dense phase powder pumps 10, 10-2 and 10-3 coincide into a single curve. As a result, a setpoint for a given conveyed powder rate set at the powder adjusting element 54 of the control unit 42 will be the same rate of conveyed powder. In this manner the three dense phase powder pumps are compensated/calibrated with respect to each other.

The adjustable change in response time delay feasible at the delay time setting element 56 can be implemented in different ways. In one preferred embodiment mode of the present invention, a variable time differential can be set at the delay time setting element 56 between a time at which the command to open the powder intake valve Q1 respectively Q2 can be generated at the powder adjusting element 54 and that time at which the command to open actually is transmitted from the control unit 42 to the control valve 1.1 respectively 1.2 of the powder intake valve Q1 respectively Q2 to be opened. In another embodiment mode of the present invention, a time differential can be set at the time delay adjusting element 56 between a time to start the suction stage defined by the setpoint at the powder setting element 54 and the actual generation in the control unit 42 of the command to open.

FIG. 4 moreover shows how to vary the slope of the curves of the dense phase powder pumps 10, 10-2 and 10-3 by changing the apparatus constant C. This change in slope may be carried out in lieu of changing the time delay or in addition to it. The change in slope can be implemented in a manner that the maximum in percent of the conveyed powder rate is equal in all dense phase powder pumps 10, 10-2 and 10-3.

In another embodiment of the present invention, the dependence modes may be stored in tabular form by means of which the control unit 42 calculates the same percentage per unit time for each adjustable percentage that can be set at the powder adjusting element 54 and accordingly controls the dense phase powder pump 10 by means of the control valves 1.1 through 1.7, as a result of which the dense powder pump 10 does in fact convey the set percentage rate of discharged powder.

Instead of being driven manually, all the values $t_{total}$, $t_{delay}$, $m_p$ and C as well as others also may be transmitted in wireless manner or through electric circuits by means of signal to the control unit 42 and be adjustable therein for instance using BUS systems such as CAN, Profi-BUS or others.

The invention claimed is:

1. A powder feed apparatus for a powder spraycoating equipment, said powder feed apparatus comprising:

a dense phase powder pump including at least one feed chamber for discharging coating powder, a powder intake valve at a powder intake of said at least one feed chamber to aspirate the coating powder during a suction stage;

a powder outlet valve at a powder outlet of said at least one feed chamber to discharge the coating powder during a discharge stage;

control valves configured to operate the dense phase powder pump; and an electric control unit including at least one computer configured to drive the dense phase power pump by the control valves, and a powder adjusting element configured to control a rate of a powder stream to be moved by the dense phase powder pump, wherein the control unit stores a function $t_{total}=t_{delay}+m_pC$ to obtain an open time of the powder intake valve during the suction stage, where $t_{total}$ is a total open time ($t_{total}$) of the powder intake valve during the suction stage from an onset of a command to open the powder intake valve to an onset of a command to close the powder intake valve from the control unit, $t_{delay}$ is a response delay time from the onset of the command to open the powder intake valve to an onset of the powder stream into the feed chamber through the powder intake valve which is at least partly open, $m_p$ denotes a percentage of the rate of the powder stream to be moved by the dense phase powder pump relative to a maximum possible rate of powder discharge of the dense phase powder pump at a predetermined maximum opening time of the powder intake valve and is adjustable by the powder adjusting element, and C is an equipment constant C, wherein the powder adjusting element has an adjustment range of 0 to 100%, said adjustment range being divided into corresponding 0 to 100% portions of a powder discharge rate of conveyed discharged powder of the dense phase powder pump, where 0% corresponds to the state when, at an end of the response delay time, the coating powder just begins streaming through the powder intake valve of the feed chamber in the suction stage, and 100% corresponds to the maximum possible rate of powder discharge of the dense phase powder pump at the predetermined maximum opening time of the powder intake valve of said at least one feed chamber, and wherein the control unit is configured to control the open time of the powder intake valve as the calculated $t_{total}$ based on the $m_p$ set in the powder adjusting element.

2. The powder feed apparatus as claimed in claim 1, wherein the division of the adjustment range of the powder adjusting element from 0 to 100% is linear and each adjusted percentage linearly corresponds to a percentage of an instantaneously conveyed powder discharge rate.

3. The powder feed apparatus as claimed in claim 1, wherein the function is stored as a mathematical function implementable by the control unit, and the control unit is configured to calculate, for each percentage adjustable at the powder adjusting element, the same percentage of the rate of discharged powder and configured to control the dense phase powder pump to convey the calculated percentage of the rate of discharged powder.

4. The powder feed apparatus as claimed in claim 1, wherein the equipment constant C is a characteristic value determined by experiment and depending on a design of the powder feed apparatus or on a powder stream impedance downstream of the dense phase powder pump.

5. The powder feed apparatus as claimed in claim 1, wherein the function is stored in the form of a plot of curves by the control unit, and the control unit is configured to calculate, for each adjustable percentage at the powder adjusting element, the same percentage of the rate of discharged powder and configured to drive the dense phase powder pump by the control valves to convey the percentage rate of discharged powder set at the powder adjusting element.

6. The powder feed apparatus as claimed in claim 1, wherein the function is stored in tabular form by the control unit, and the control unit is configured to calculate, for each percentage adjustable at the powder adjusting element, the same percentage of the rate of discharged powder and configured to drive the dense phase powder pump to convey the adjusted percentage of the rate of discharged powder.

7. The powder feed apparatus as claimed in claim 1, wherein the control unit further comprises a delay time adjusting element for adjusting the response delay time, in a first mode or a second mode, by using a time differential, which is adjustable by the delay time adjusting element, in the first mode, the time differential is set at the delay time adjusting element between (i) a time to start the suction stage defined by a powder feed setpoint on the adjustment range at the powder adjusting element and (ii) a time at which the command to open the powder intake valve is in fact being generated, and in the second mode, the time differential is set at the delay time adjusting element between (a) a time at which the command to open the powder intake valve is generated, and (b) a time at which the command to open the powder intake valve is transmitted by the control unit to the control valve to be opened.

8. The powder feed apparatus as claimed in claim 1, wherein the powder intake valve and the powder outlet valve are pinch valves.

9. The powder feed apparatus as claimed in claim 8, further comprising a compressed air chamber enclosing compressed air, wherein the pinch valves comprise a flexible hose subtending a coating powder valve duct and being collapsible by the compressed air to close the valve duct, and the hose is mechanically prestressed to be automatically reopenable when the compressed air is no longer applied.

10. A powder spraycoating equipment, comprising a powder feed apparatus including:

a dense phase powder pump including at least one feed chamber for discharging coating powder, a powder intake valve at a powder intake of said at least one feed chamber to aspirate the coating powder during a suction stage;

a powder outlet valve at a powder outlet of said at least one feed chamber to discharge the coating powder during a discharge stage;

control valves configured to operate the dense phase powder pump; and an electric control unit including at least one computer configured to drive the dense phase power pump by the control valves, and a powder adjusting element configured to control a rate of a powder stream to be moved by the dense phase powder pump, wherein the control unit stores a function $t_{total}=t_{delay}+m_pC$ to obtain an open time of the powder intake valve during the suction stage, where $t_{total}$ is a total open time ($t_{total}$) of the powder intake valve during the suction stage from an onset of a command to open the powder intake valve to an onset of a command to close the powder intake valve from the control unit, $t_{delay}$ is a response delay time from the onset of the command to open the powder intake valve to an onset of the powder stream into the feed chamber through the powder intake valve which is at least partly open, $m_p$ denotes a percentage of the rate of the powder stream to be moved by the dense phase powder pump relative to a maximum possible rate of powder discharge of the dense phase powder pump at a predetermined maximum opening time of the powder intake valve and is adjustable by the powder adjusting element, and C is an equipment constant C, wherein the powder adjusting element has an adjustment range of 0 to 100%, said adjustment range being divided into corresponding 0 to 100% portions of a powder discharge rate of conveyed discharged powder of the dense phase powder pump, where 0% corresponds to the state when, at an end of the response delay time, the coating powder just begins streaming through the powder intake valve of the feed chamber in the suction stage, and 100% corresponds to the maximum possible rate of powder discharge of the dense phase powder pump at the predetermined maximum opening time of the powder intake valve of said at least one feed chamber, and wherein the control unit is configured to control the open time of the powder intake valve as the calculated $t_{total}$ based on the $m_p$ set in the powder adjusting element.

* * * * *